US005135326A

United States Patent [19]

Mitani et al.

[11] Patent Number: 5,135,326

[45] Date of Patent: Aug. 4, 1992

[54] ARTICULATED SHIELD TUNNELING MACHINE

[75] Inventors: Norio Mitani, Hirakata; Hideo Kanbayashi, Katano; Yoshihisa Yamamoto, Hirakata, all of Japan

[73] Assignee: Kabushiki Kaisha Komatsu Seisakusho, Tokyo, Japan

[21] Appl. No.: 445,671

[22] PCT Filed: May 11, 1989

[86] PCT No.: PCT/JP89/00481

§ 371 Date: Nov. 29, 1989

§ 102(e) Date: Nov. 29, 1989

[87] PCT Pub. No.: WO89/11582

PCT Pub. Date: Nov. 30, 1989

[30] Foreign Application Priority Data

May 16, 1988 [JP] Japan ..... 63-63415

[51] Int. Cl.[5] ..... E21D 9/00

[52] U.S. Cl. ..... 405/143; 405/138; 299/31; 299/33

[58] Field of Search ..... 405/143, 146, 138, 141; 299/31, 33

[56] References Cited

U.S. PATENT DOCUMENTS 3,379,024 4/1968 Wohlmeyer ..... 405/143 X
4,420,188 12/1983 Robbins et al. ..... 405/143 X
4,474,494 10/1984 Stuckmann et al. ..... 405/143

FOREIGN PATENT DOCUMENTS 82198 4/1987 Japan .
133290 6/1987 Japan .
146393 6/1987 Japan .
170698 7/1987 Japan .

*Primary Examiner*—Dennis L. Taylor
*Attorney, Agent, or Firm*—Richards, Medlock & Andrews

[57] ABSTRACT

An articulated shield tunneling machine suitable for excavation along a curvature with an articulated shield having front and rear shield sections. In contrast to the conventional apparatus which suffers from various disadvantages such as interference between the front ends of shield jacks with front shield section and necessity for expensive strong construction of shield jacks, the articulated shield tunneling machine of the present invention has trunnions (10) to which the shield jacks (7) are connected, and the trunnions (10) are connected to front portions of the rear shield section (1*b*) for pivotal movement in the radial direction of the articulated shield (1). Each trunnion (10) can have therein an elastic member which urges the front end of the shield jack (7) towards the center of the articulated shield (1). With this arrangement, it is possible to conduct excavation along a curve of a small radius of curvature, with a simple and inexpensive articulated shield composed of two shield sections, without allowing any interference between the shield jacks and the front shield section.

20 Claims, 7 Drawing Sheets

ARTICULATED SHIELD TUNNELING MACHINE

FIELD OF THE INVENTION

The present invention relates to a shield type tunneling machine and, more particularly, to an articulated shield tunneling machine which is capable of advancing an articulated shield along a curve.

BACKGROUND OF THE INVENTION

In general, mechanical shield excavation of a curved tunnel is conducted by advancing a shield along the curve by uneven operation of shield jacks acting on different points on the shield, while conducting overbreak by means of an over cutter or a copy cutter. With such a known method, however, it is impossible to reduce the radius R of curvature to a level below a certain value, e.g., 100 meters. In order to execute curved tunnel excavation, therefore, an articulated shield tunneling machine has been employed in which the shield is composed of two or three sections which are articulated one to another so as to allow flexing of the shield at articulates between, for example, the front and the middle shield sections and between the middle and rear shield sections.

The articulated shield composed of two shield sections, i.e., a front section and a rear section, are sorted into two types: namely, a first type in which shield jacks are held on the front shield section and a second type in which the shield jacks are held by the rear shield section. The first type of the articulated shield is exemplarily shown in FIG. 1. As will be seen from this Figure, shield jacks 27 are supported by the front shield section 21*a*. A too large flexing angle $\alpha$ of shield section 21*b* undesirably causes the radially inner shield jack 27 to interfere with the front end of the rear shield section 21*b*. In addition, the point 27*b* of action of the force exerted by the radially inner shield jack on the segment 29 in the rear shield section 21*b* is offset towards the center of the rear shield section 21*b* with the result that a reactional force is produced to deform the segment 29. On the other hand, the distance between the radially outer shield jack 27 and the associated segment 29 is increased so that the end of the shield jack 27 may fail to reach the segment 29 even when the shield jack is fully extended.

The second type of shield has the shield jacks 27 held on the rear shield section 21*b*, as shown in FIG. 2. This type of shield also encounters a problem in that a too large flexing angle $\alpha$ of the front shield section 21*a* with respect to the rear shield section 21*b* undesirably causes one of the shield jacks 27 to interfere with the front end of the front shield section 21*a*. Anyway, with known articulated shields composed of front and rear shield sections, it has been impossible to excavate a tunnel along a curve having a small radius of curvature, e.g., 30 meters or less.

In order to avoid interference between the front end of the shield jack 27 and the front shield section 21*a*, it would be advisable to mount the shield jack 27 at an offset towards the center of the rear shield section, as proposed in Japanese Utility Model Unexamined Publication No. 59-167891. In such a case, however, the offset $\epsilon$ of the point of action of force on the segment 29 from the axis of the shield jack 27 becomes large so that the shield jack is required to have a construction which is strong and, hence, expensive.

On the other hand, an articulated shield composed of three shield sections is capable of performing excavation along an acute curve which has a small radius of curvature, e.g., 30 meters or smaller, at a cost that the overall length of the shield becomes large as compared with articulated shields having two sections, and pairs of shield jacks are required on both ends of the central shield segment, resulting in a complicated and expensive construction as compared with the articulated shield having two sections.

SUMMARY OF THE INVENTION

Accordingly, an object of the present invention is to provide an articulated shield tunneling machine which enables excavation along a curve of a small radius of curvature without causing interference between a shield jack and a shield section even when the articulated shield is composed of only two sections and which is simple in construction and, hence, less-expensive as compared with known articulated shield tunneling machines.

To this end, according to the present invention, there is provided an articulated shield tunneling machine having an articulated shield which is composed at least of a front shield section and a rear shield section, comprising: articulate jacks acting between the front shield section and the rear shield section so as to flex the articulated shield such that the front and rear shield sections are inclined to each other; shield jacks provided between the front shield section and the rear shield section and capable of producing a force for advancing the articulated shield; and trunnions secured to the shield jacks and connected to front portions of said rear shield section for pivotal movement in the radial direction of the articulated shield.

In a preferred form of the present invention, each of the trunnions is provided therein with an elastic member which urges the front end of the associated shield jack towards the center of the shield member.

According to the invention, a large clearance is preserved between the front shield section and the shield jacks even when the articulated shield is flexed at a large angle at its portion between the front and rear shield sections, thus eliminating any risk for the shield jacks to interfere with the front shield section.

In addition, the amount of offset between the center of the shield jack and the point of action of force on the associated segment is not so large; thus the requirement for the high strength of the shield jacks becomes less strict and, hence, the cost is reduced advantageously. The shield jacks are allowed to swing only in the radial direction of the articulated shield, i.e., the swinging of the same in the circumferential direction is restricted. This eliminates any risk for the articulated shield to roll by the excavation reactional force transmitted from the cutter head. The shield jacks held by the rear shield section can by no means interfere with the rear shield section, and the positions of the points of action of force exerted by the shield jacks on the associated segments are unchanged regardless of flexing of the articulated shield. In consequence, problems such as deformation of segments and shortage of the shield jack failing to reach the associated segment are also avoided.

DESCRIPTION OF THE PREFERRED EMBODIMENTS

Figure 1:
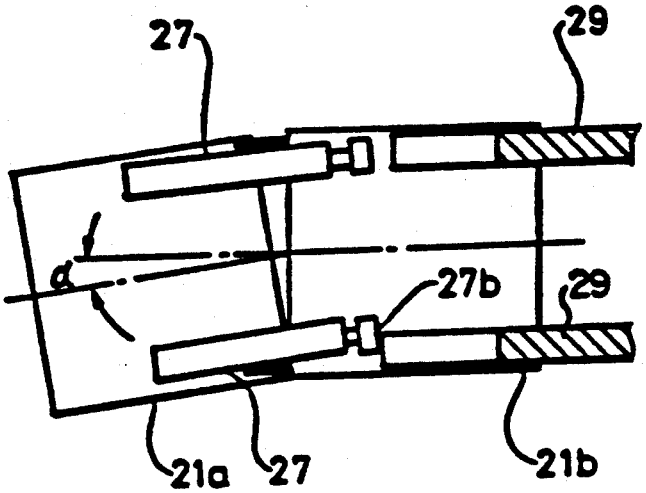
FIG. 1 (PRIOR ART)
FIG. 1 is an illustration of a known articulated shield composed of a front shield section and a rear shield section, with shield jacks held on the front shield section.
Figure 2:
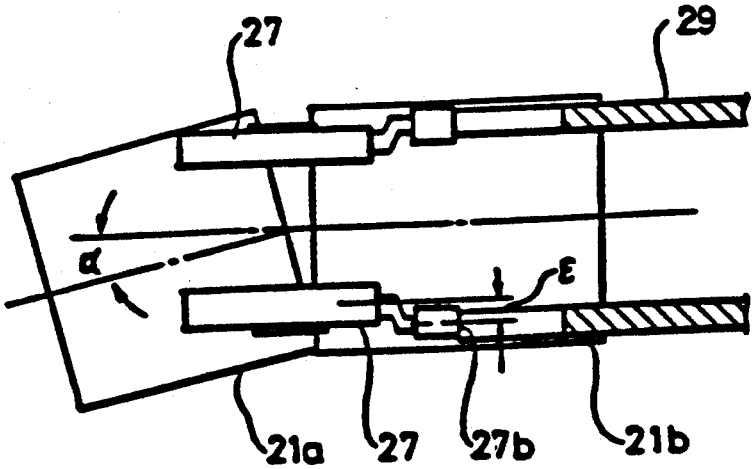
FIG. 2 (PRIOR ART)
FIG. 2 is an illustration of a known articulated shield composed of a front shield section and a rear shield section, with shield jacks held on the rear shield section.
Figure 3:
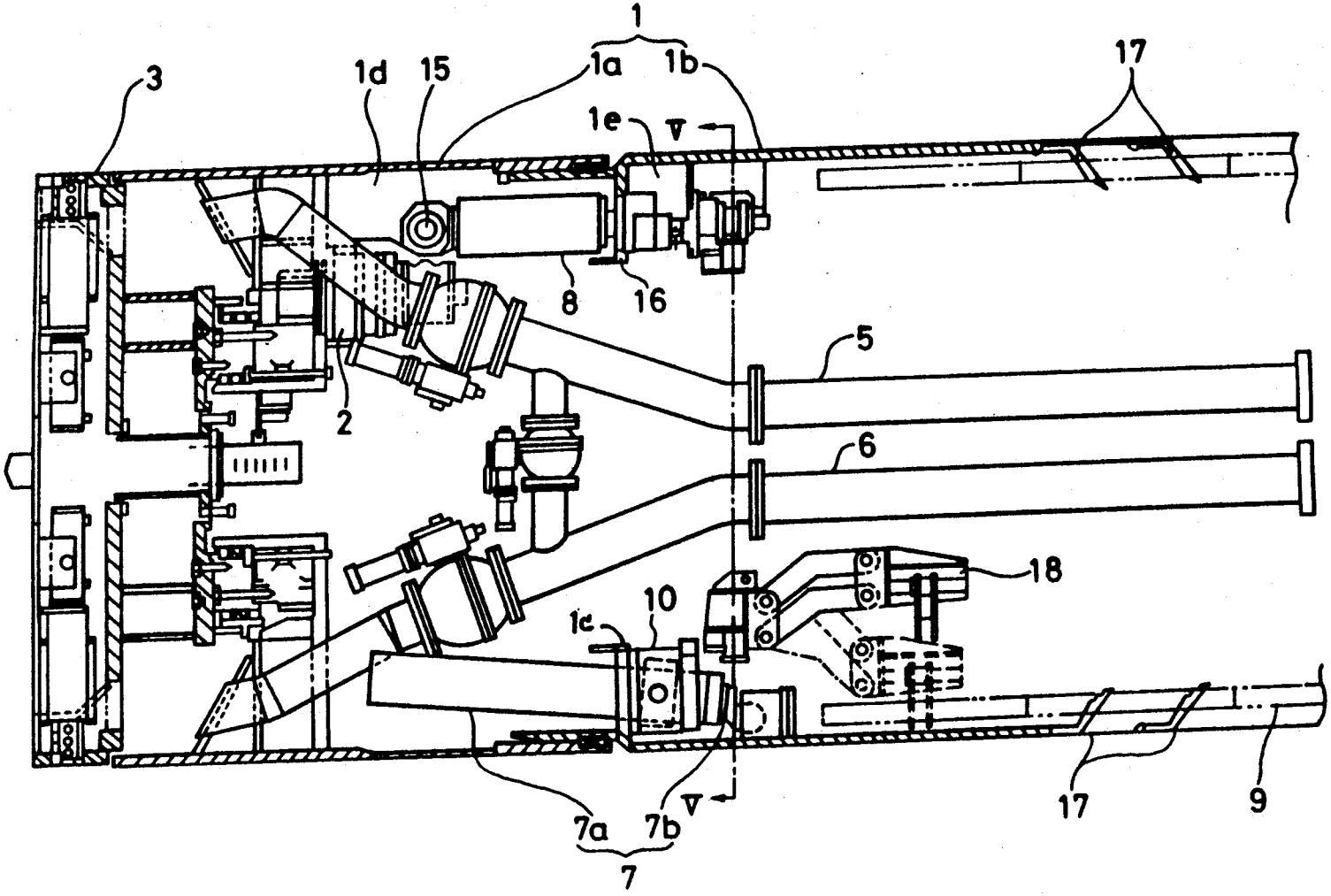
FIG. 3 is a longitudinal sectional view of an embodiment of an articulated shield tunneling machine of the invention in which the articulated shield is composed of two shield sections.
Figure 4:
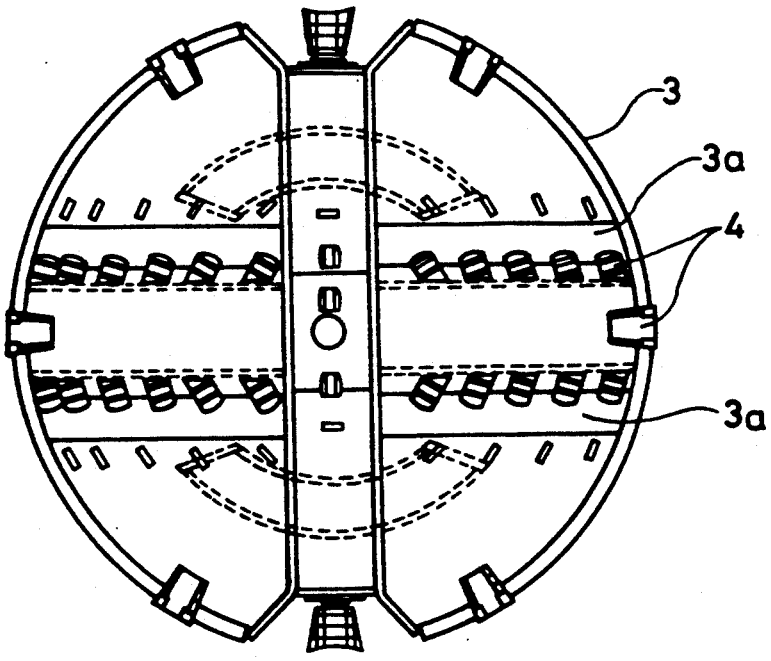
FIG. 4 is a front elevational view of the embodiment shown in FIG. 3.
Figure 5:
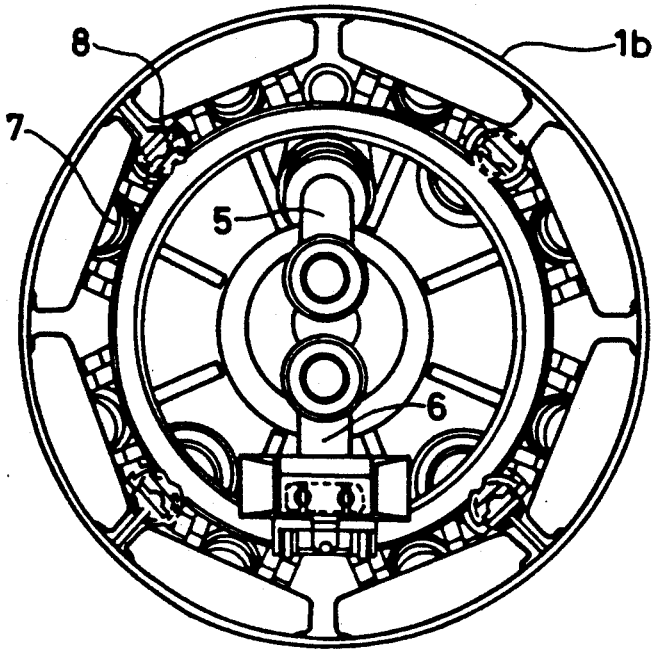
FIG. 5 is a sectional view taken along the line V—V of FIG. 3.

FIG. 3 is a longitudinal sectional view of an embodiment of the articulated shield tunneling machine of the invention, employing an articulated shield 1 composed of two shield sections: namely, a front shield section 1*a* and a rear shield section 1*b* which are flexurally articulated to each other. The articulated shield tunneling machine has a cutter head 3 mounted on the front end of the front shield 1*a* and driven by a power source which is typically a hydraulic motor. As will be seen from FIG. 4 which is a front elevational view, a multiplicity of cutters 4 are arranged on the front and outer peripheral portion of the cutter head 3.

These cutters 4 cut the tunnel face ahead of the shield 1, while soil and sand from the tunnel face are taken into the cutter head 3 through an intake opening 3*a*. The soil and sand are changed into slurry by muddy water supplied through a muddy water pipe 5 and the thus formed slurry is discharged rearwardly through a discharge pipe 6 which also extends through the shield 1.

A plurality of shield jacks 7 and a plurality of articulate jacks 8 are arranged alternately in the circumferential direction, between the front shield section 1*a* and the rear shield section 1*b* of the articulated shield 1. Each shield jack 7 is composed of a cylinder 7*a* and a rod 7*b* which, when extended, is capable of acting on an associated segment 9 behind the shield 1 so as to produce a reactional force which serves to advance the shield 1 into the ground. The end of the cylinder 7*a* adjacent to its rod is connected through a trunnion 10 to a bracket 1*c* provided on the inner side of the front end of the rear shield section 1*b* so that the cylinder 7*a* can pivot towards the center of the articulated shield 1.

Figure 6:
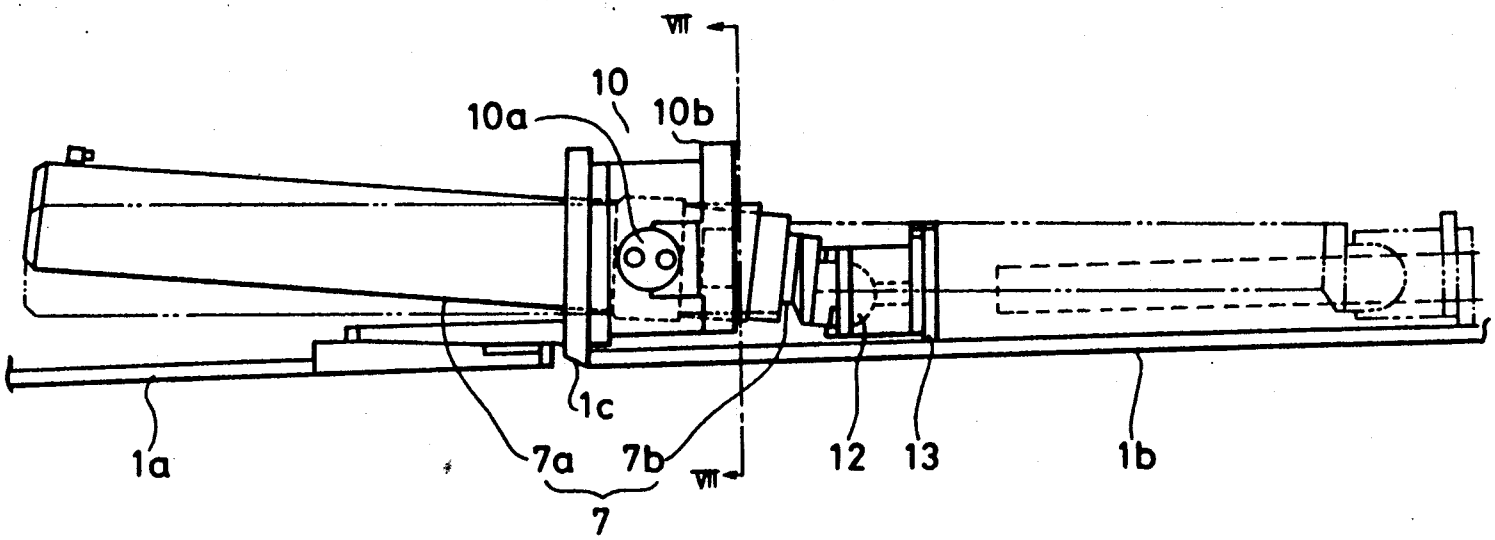
FIG. 6 is a side elevational view of a shield jack incorporated in the embodiment of the present invention.
Figure 7:
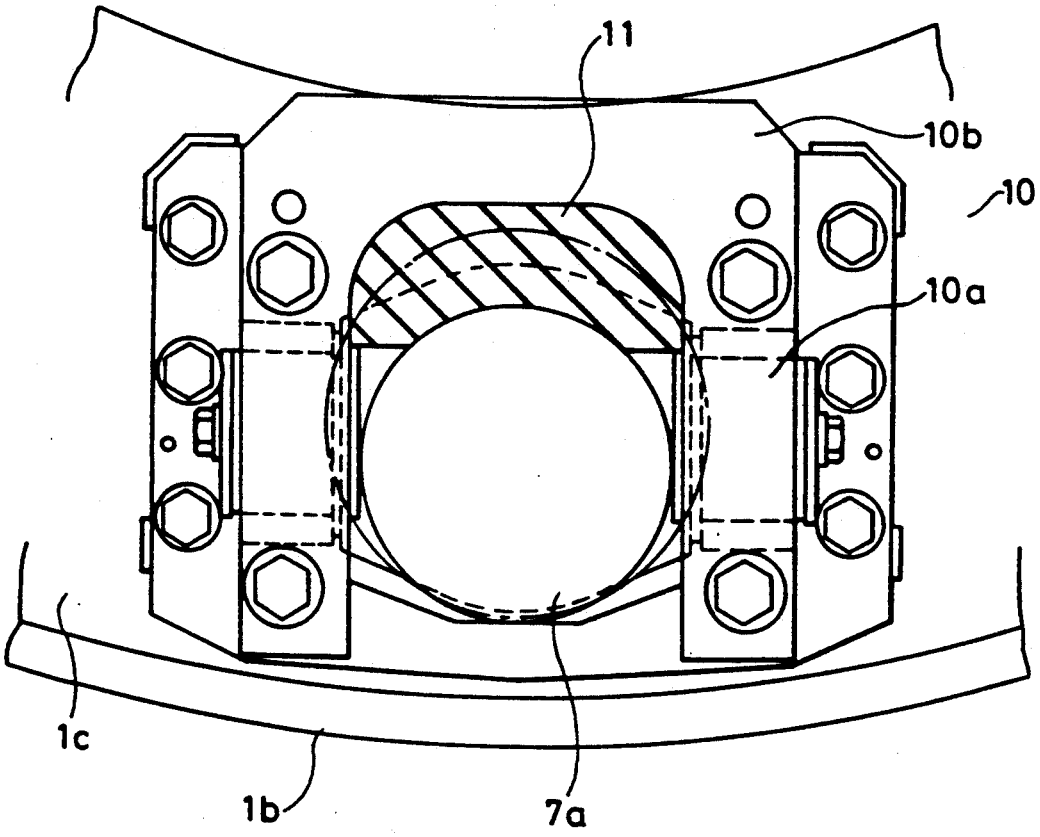
FIG. 7 is an enlarged sectional view taken along the line VII—VII of FIG. 6.

FIG. 6 is a side elevational view of the embodiment, illustrating in particular the manner in which each shield jack 7 is secured, while FIG. 7 is an enlarged sectional view taken along the line VII—VII of FIG. 6. The trunnion 10 has a trunnion shaft 10*a* which extends perpendicularly to the axis of the cylinder 7*a*. The trunnion shaft 10*a* is rockably supported by a trunnion bearing 10*b* which is secured to the bracket 1*c*. Thus, each whole shield jack 7 is capable of swinging or pivoting about the axis of the trunnion shaft 10*a*. The trunnion bearing 10*b* is provided therein with an elastic member 11 such as of a rubber, capable of urging the cylinder 7*a* such that the bottom end of the cylinder 7*a* is directed towards the center of the articulated shield 1.

The rear end of the piston rod 7*b* extending rearwardly from the associated cylinder 7*a* is connected to a segment anvil 13, through a spherical joint 12 having a rotation center at a position which is slightly offset outwardly from the center of the piston rod 7*b*. The segment anvil 13 is capable of abutting the front end of the associated segment 9.

As will be seen from FIG. 3, each of the articulate jacks 8 disposed alternately with the shield jacks 7 is capable of flexing the articulated shield at a portion between the front shield section la and the rear shield section 1*b*. Each articulate jack 8 is pivotally connected at one end through a pin 15 to a bracket 1*d* which is provided on the front shield section 1*a*, while the other end is pivotally connected through a pin 16 to a bracket 1*e* which is secured to the front end of the rear shield section 1*b*. The rear shield section 1*b* is provided with a seal member 17 for preventing soil from coming into the shield 1 through the gap between the rear shield 1*b* and the segments 9, as well as segment erectors 18 for building up the segments 9.

When the described articulated shield operates for linear excavation, the axes of the front and rear shield sections 1*a* and 1*b* of the articulated shield 1 align with each other. The cutter head 3 is rotated while the articulated shield is straightened, so as to cut the tunnel face, while the shield jacks 7 are simultaneously extended to produce equal reactional forces on all the segments 9, whereby the articulated shield 1 is moved ahead. The soil cut from the tunnel face is taken into the cutter head 3 and is changed into slurry by being mixed with muddy water supplied through a muddy water pipe 5. The thus formed slurry is discharged rearwardly from the articulated shield 1 through the discharge pipe 6.

For the purpose of excavation along a curve, the articulate jacks 8 between the front and rear shield sections 1*a* and 1*b* are selectively operated such that some of them are extended while the others are retracted so as to flex the articulated shield 1 in such a manner that a flex angle $\alpha$ corresponding to the curvature is formed between the front and rear shield sections 1*a* and 1*b*.

Figure 8:
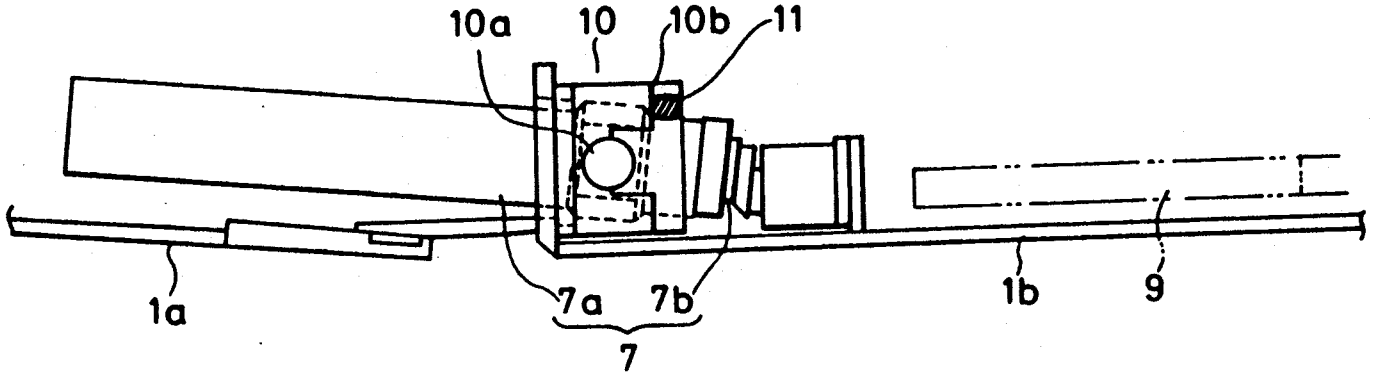
FIGS. 8 and 9 are illustrations of operation of shield jacks used in the embodiment of the present invention.
Figure 9:
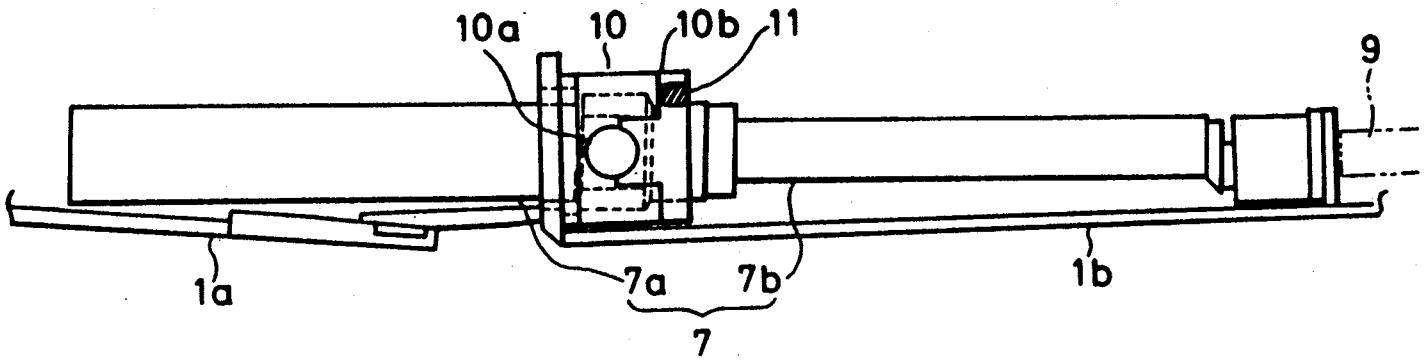
Figure 10:
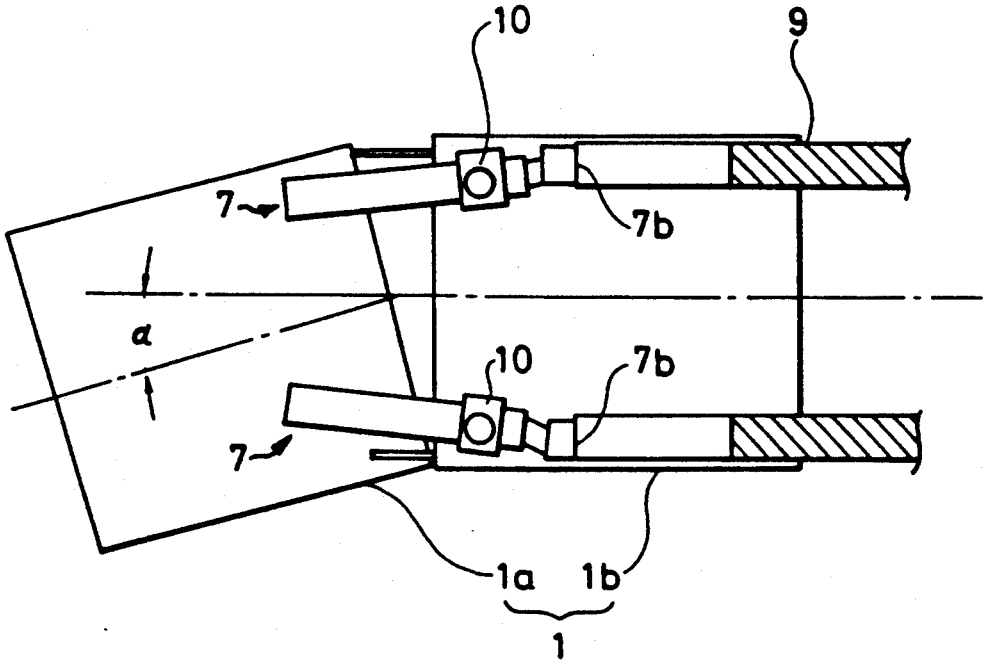
FIG. 10 is an illustration of the manner in which an articulated shield composed of front and rear sections is advanced in accordance with the embodiment of the present invention.

The shield jacks 7 are then extended simultaneously so that the articulated shield 1 is advanced along the expected curve. As shown in FIG. 8, the bottom end of the cylinder 7*a* of each shield jack 7 is urged by the elastic member 11 provided in the trunnion bearing 10*b* towards the center of the articulated shield 1, so that a large clearance is formed between the front shield section 1*a* and the bottom end of the cylinder 7*a* Consequently, the shield jacks 7 do not interfere with the front shield section even when they are fully extended as shown in FIG. 9, in contrast to conventional arrangement which involves the risk of interference. It has been confirmed that, according to the invention, a maximum flex angle $\alpha$ of 6 degrees or greater, which well compared to that obtained by known three-section-type articulated shield, can be obtained even with an articulated shield having two sections. When the articulated shield 1 is advanced with the flex angle $\alpha$ as shown in FIG. 10, each shield jack 7 swings about the axis provided by the respective trunnion 10 so that it can follow the flexure of the articulated shield without changing the position of the point 7*b* of action of force on the associated segment 9. This eliminates any risk for the segment 9 to be deformed or broken due to local or uneven application of the reactional thrust which may otherwise be caused on the segment 9. In addition, the amount of offset of the point 7*b* of action of force from the center axis of the shield jack 7 is reduced so that the requirement for the high strength of the shield jack 7 becomes less strict. Furthermore, since the shield jacks 7 are allowed to swing only in the radial direction of the articulated shield 1 and are restricted in movement in the circumferential direction, any undesirable rolling of the articulated shield 1 due to reactional force produced during excavation is advantageously eliminated.

As will be fully understood from the foregoing description, the articulated shield tunneling machine of the present invention enables an articulated shield composed of two shield sections to be advanced along a curve of a comparatively small radius of curvature, without being accompanied by any substantial complication in the construction and rise in the cost.

We claim:

1. In an articulated shield tunneling machine having a two section articulated shield in the form of a front shield section and a rear shield section, the improvement comprising:

a plurality of articulate jacks connected between said front shield section and said rear shield section and adapted to flex said articulated shield between a first position wherein the axes of said front and rear shield sections are aligned with each other and a second position wherein the axes of said front and rear sections are inclined to each other;

a plurality of shield jacks extending into said front shield section and into said rear shield section and being capable of producing a force for advancing said articulated shield, each of said shield jacks comprising a cylinder and a piston rod, each said cylinder having a rod end and a front end; and a plurality of trunnions, each of said trunnions having a trunnion shaft rockably supported by a trunnion bearing, each of the trunnion shafts being secured to the rod end of the cylinder of a respective one of said shield jacks, each of the trunnion bearings being connected to a respective front portion of said rear shield section for pivotal movement of the respective shield jack about the associated trunnion shaft in the radial direction of said articulated shield while preserving a clearance between the front shield section and the respective shield jack even when the front and rear sections are inclined to each other at a large angle.

2. An articulated shield tunneling machine according to claim 1, wherein each of said trunnions is provided with an elastic member which urges the front end of the associated shield jack towards the center of said articulated shield.

3. An articulated shield tunneling machine according to claim 2 wherein said plurality of articulate jacks and said plurality of shield jacks are arranged alternately with respect to each other about the circumference of said articulated shield.

4. An articulated shield tunneling machine according to claim 3 wherein each piston rod is connected to an anvil through a spherical joint having a rotation center at a position which is slightly offset outwardly from the center of the respective piston rod.

5. An articulated shield tunneling machine according to claim 4 wherein one end of each articulate jack is pivotally connected to said front shield section and the other end of the articulate jack is pivotally connected to the front end of the rear shield section.

6. An articulated shield tunneling machine according to claim 5 wherein said shield jacks are restricted in swinging movement in the circumferential direction with respect to said articulated shield.

7. An articulated shield tunneling machine according to claim 1 wherein said plurality of articulate jacks and said plurality of shield jacks are arranged alternately with respect to each other about the circumference of said articulated shield.

8. An articulated shield tunneling machine according to claim 1 wherein each piston rod is connected to an anvil through a spherical joint having a rotation center at a position which is slightly offset outwardly from the center of the respective piston rod.

9. An articulated shield tunneling machine according to claim 1 wherein one end of each articulate jack is pivotally connected to said front shield section and the other end of the articulate jack is pivotally connected to the front end of the rear shield section.

10. An articulated shield tunneling machine according to claim 1 wherein said shield jacks are restricted in swinging movement in the circumferential direction with respect to said articulated shield.

11. An articulated shield tunneling machine according to claim 1 wherein each piston rod is connected to an anvil through a spherical joint having a rotation center at a position which is slightly offset outwardly from the center of the respective piston rod, and wherein said shield jacks are restricted in swing movement in the circumferential direction with respect to said articulated shield.

12. In an articulated shield tunneling machine having a two section articulated shield in the form of a front shield section and a rear shield section, the improvement comprising:

a plurality of articulate jacks connected between said front shield section and said rear shield section and adapted to flex said articulated shield between a first position wherein the axes of said front and rear shield sections are aligned with each other and a second position wherein the axes of said front and rear sections are inclined to each other;

a plurality of shield jacks extending into said front shield section and into said rear shield section and being capable of producing a force for advancing said articulated shield, wherein each of said shield jacks comprises a cylinder and a piston rod, each said cylinder having a rod end and a front end; and a plurality of trunnions, each of said trunnions having a trunnion shaft rockably supported by a trunnion bearing, each of the trunnion shafts being secured to the rod end of the cylinder of a respective one of said shield jacks, each of the trunnion bearings being connected by a bracket to a respective front portion of said rear shield section for pivotal movement of the whole respective shield jack about the associated trunnion shaft in the radial direction of said articulated shield while restricting movement of the respective shield jack in the circumferential direction of said articulated shield, thus preserving a clearance between the front shield section and the respective shield jack even when the front and rear shield sections are inclined to each other at a large angle, thus eliminating any risk of the shield jacks interfering with the front shield section;

each of said trunnions being provided with an elastic member positioned between the respective trunnion bearing and the rod end of the cylinder of the associated shield jack, which elastic member urges the rotation of the cylinder of the associated shield jack about the associated trunnion shaft such that the front end of the associated shield jack is urged towards the center of said articulated shield.

13. An articulated shield tunneling machine according to claim 12 wherein each piston rod is connected to an anvil through a spherical joint having a rotation center at a position which is slightly offset outwardly from the center of the respective piston rod.

14. An articulated shield tunneling machine according to claim 13 wherein one end of each articulate jack is pivotally connected to said front shield section and the other end of the articulate jack is pivotally connected to the front end of the rear shield section.

15. An articulated shield tunneling machine according to claim 14 wherein said shield jacks are restricted in swing movement in the circumferential direction with respect to said articulated shield.

16. An articulated shield tunneling machine according to claim 15 wherein said plurality of articulate jacks and said plurality of shield jacks are arranged alternately with respect to each other about the circumference of said articulated shield.

17. An articulated shield tunneling machine according to claim 12 wherein said plurality of articulate jacks and said plurality of shield jacks are arranged alternately with respect to each other about the circumference of said articulated shield.

18. An articulated shield tunneling machine according to claim 12 wherein each piston rod is connected to an anvil through a spherical joint having a rotation center at a position which is slightly offset outwardly from the center of the respective piston rod.

19. An articulated shield tunneling machine according to claim 12 wherein one end of each articulate jack is pivotally connected to said front shield section and the other end of the articulate jack is pivotally connected to the front end of the rear shield section.

20. An articulated shield tunneling machine according to claim 12 wherein said shield jacks are restricted in swing movement in the circumferential direction with respect to said articulated shield.

* * * * *